US010608416B2

(12) United States Patent
Nakamura

(10) Patent No.: US 10,608,416 B2
(45) Date of Patent: Mar. 31, 2020

(54) SPARK PLUG

(71) Applicant: NGK SPARK PLUG CO., LTD., Nagoya-shi, Aichi (JP)

(72) Inventor: Mai Nakamura, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/458,352

(22) Filed: Jul. 1, 2019

(65) Prior Publication Data

US 2020/0014177 A1 Jan. 9, 2020

(30) Foreign Application Priority Data

Jul. 5, 2018 (JP) ..... 2018-127966

(51) Int. Cl.
*H01T 13/38* (2006.01)
*H01T 13/08* (2006.01)
*H01T 13/06* (2006.01)

(52) U.S. Cl.
CPC ..... *H01T 13/38* (2013.01); *H01T 13/06* (2013.01); *H01T 13/08* (2013.01)

(58) Field of Classification Search
CPC ..... H01T 13/38; H01T 13/08; H01T 13/06
See application file for complete search history.

(56) References Cited

U.S. PATENT DOCUMENTS

2012/0169207 A1* 7/2012 Kato ..... H01T 13/04 313/141
2013/0196272 A1* 8/2013 Camilli ..... H01T 13/40 431/6
2014/0145405 A1* 5/2014 Suzuki ..... H01T 13/08 277/650
2015/0340842 A1* 11/2015 Ozeki ..... H01T 13/36 313/143
2018/0205204 A1* 7/2018 Sugiura ..... F02P 13/00

FOREIGN PATENT DOCUMENTS

JP 2012-128948 A 7/2012

* cited by examiner

*Primary Examiner* — Kevin Quarterman
(74) *Attorney, Agent, or Firm* — Kusner & Jaffe

(57) ABSTRACT

The spark plug includes: an insulator having an axial hole formed along an axial line; and a metal terminal provided on a rear side of the axial hole of the insulator. The metal terminal has, at a rear end portion thereof, a bottom surface facing rearward and a projection projecting rearward from an outer edge of the bottom surface, and a mark is provided to at least a part of the bottom surface. The Vickers hardness of the projection is 100 HV or higher. A rear end surface of the projection is positioned on a rear side with respect to a rear end of the mark. An area of the rear end surface is 3 $mm^2$ or greater.

7 Claims, 3 Drawing Sheets

SPARK PLUG

RELATED APPLICATIONS

This application claims the benefit of Japanese Patent Application No. 2018-127966, filed Jul. 5, 2018, the entire content of which is incorporated herein by reference.

FIELD OF THE INVENTION

The present invention relates to a spark plug, and in particular, a spark plug in which a mark is provided to a metal terminal.

BACKGROUND OF THE INVENTION

There is known a spark plug provided with an identifier (mark) defined in advance, in order to prevent erroneous mounting of the spark plug to an engine or allow tracking of history information about the spark plug. In technology disclosed in Japanese Patent Application Laid-Open (kokai) No. 2012-128948, a spark plug has a projection projecting rearward from the outer edge of the bottom surface of a metal terminal that faces the rear side, and a mark is provided to the bottom surface of the metal terminal. Owing to the projection, an external force which can lead to peeling or damage of the mark is less likely to be exerted on the bottom surface, so that peeling or damage of the mark is suppressed. Thus, occurrence of reading error of the mark can be suppressed.

For this type of spark plug, technology for further suppressing peeling or damage of the mark is being required.

The present invention has been made to address such requirements. An advantage of the present invention is a spark plug that enables the effect of suppressing peeling or damage of the mark.

SUMMARY OF THE INVENTION

In accordance with the present invention there is provided a spark plug that includes: an insulator having an axial hole formed along an axial line extending from a front side to a rear side; and a metal terminal provided on a rear side of the axial hole of the insulator, wherein the metal terminal has, at a rear end portion thereof, a bottom surface facing rearward and a projection projecting rearward from an outer edge of the bottom surface, a mark being provided to at least a part of the bottom surface, Vickers hardness of the projection is 100 HV or higher, a rear end surface of the projection is positioned on a rear side with respect to a rear end of the mark, and an area of the rear end surface is 3 $mm^2$ or greater.

In accordance with a first aspect of the invention, there is provided a spark plug as describe above wherein, the Vickers hardness of the projection is 100 HV or higher and the area of the rear end surface of the projection positioned on the rear side with respect to the rear end of the mark is 3 $mm^2$ or greater, so that the size and the strength of the projection can be ensured. Owing to the projection, an external force that can lead to peeling or damage of the mark is less likely to be exerted on the bottom surface, and thus the effect of suppressing peeling or damage of the mark can be enhanced.

In accordance with a second aspect of the invention, there is a provided a spark plug as described above wherein, the projection projects rearward from the entire circumference of the outer edge of the bottom surface, so that an external force that can lead to peeling or damage of the mark is even less likely to be exerted on the bottom surface. Thus, in addition to the effect of the first aspect, the effect of suppressing peeling or damage of the mark can be further enhanced.

In accordance with a third aspect of the invention, there is a provided a spark plug as described above wherein, a gap is provided between the edge of the mark provided to the bottom surface and the outer edge of the bottom surface, whereby reduction in readability of the mark due to the projection can be suppressed. Therefore, in addition to the effect of the first or second aspect, occurrence of reading error of the mark can be suppressed.

In accordance with a the fourth aspect of the invention, there is a provided a spark plug as described above wherein, the mark is a code that allows information to be read therefrom with use of reflected light. The gap between the edge of the code provided to the bottom surface and the outer edge of the bottom surface is 0.03 mm or greater, and the distance along the axial line between the bottom surface and the rear end surface of the projection is 1.5 mm or smaller. Therefore, in addition to the effect of any one of the first to third aspects, occurrence of reading error of the mark can be suppressed.

DETAILED DESCRIPTION OF THE INVENTION

Figure 1:
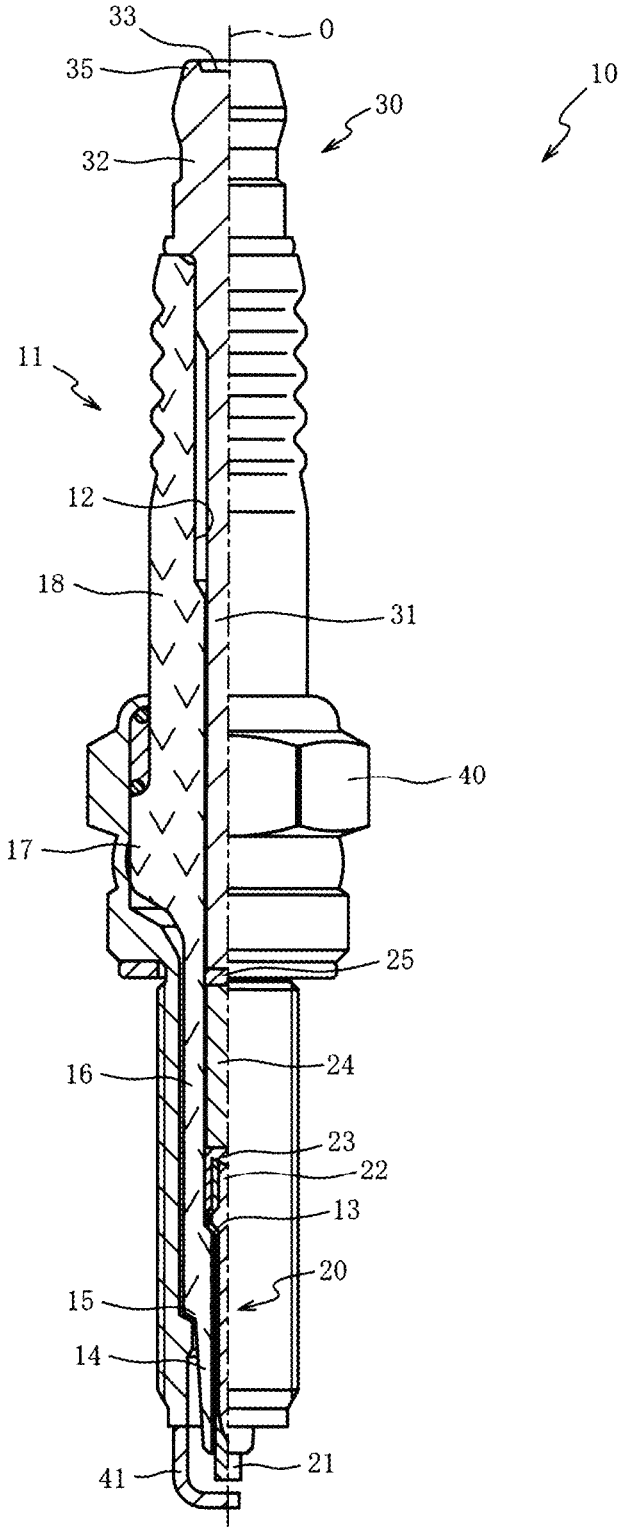
FIG. 1 is a half-sectional view of a spark plug according to the first embodiment.

Hereinafter, preferred embodiments of the present invention will be described with reference to the accompanying drawings. FIG. 1 is a half-sectional view of a spark plug 10 according to the first embodiment, with an axial line O as a boundary. In FIG. 1, the lower side on the drawing sheet is referred to as a front side of the spark plug 10, and the upper side on the drawing sheet is referred to as a rear side of the spark plug 10. As shown in FIG. 1, the spark plug 10 includes an insulator 11 and a metal terminal 30.

The insulator 11 is a substantially cylindrical member made from, for example, alumina, which is excellent in mechanical property and in insulation property under high temperature, and has an axial hole penetrating therethrough along the axial line O. An inner circumferential surface 12 of the insulator 11 through which the axial hole penetrates has, on the front side, a rearward facing surface 13 having an inner diameter gradually reducing toward the front side.

The insulator 11 has a front end portion 14, an engagement portion 15, a small-diameter portion 16, a large-diameter portion 17, and a rear end portion 18 which are contiguously formed in this order from the front side to the rear side along the axial line O. The front end portion 14 is a portion located on the front side in the axial line direction, and the outer circumferential surface of the front end portion 14 has a diameter reducing toward the front side. The outer circumferential surface of the engagement portion 15 has a diameter expanding toward the rear side. The small-diameter portion 16 has a substantially constant outer diameter over the entire length in the axial line direction. The large-diameter portion 17 has a substantially constant outer diameter over the entire length in the axial line direction. The outer diameter of the large-diameter portion 17 is greater than the outer diameter of the small-diameter portion 16. The outer diameter of the rear end portion 18 is smaller than the outer diameter of the large-diameter portion 17.

A center electrode 20 is a rod-shaped member extending along the axial line O, and is formed by coating, with nickel or nickel-based alloy, a core material made from copper or containing copper as a main component. The core material may be omitted. The center electrode 20 has an axial portion 21, and a head portion 22 adjacent to the rear side of the axial portion 21 and having a larger outer diameter than the axial portion 21. The center electrode 20 is provided such that the head portion 22 is engaged with the rearward facing surface 13 of the insulator 11 and the front side of the axial portion 21 protrudes from the front end of the insulator 11.

A first seal 23 is a conductive member for sealing and fixing the head portion 22 of the center electrode 20 with respect to the inner circumferential surface 12 of the insulator 11. A conductor 24 is a member for suppressing electric wave noise which occurs during discharging, and is provided on the rear side of the first seal 23 inside the inner circumferential surface 12. The conductor 24 is electrically connected to the center electrode 20 via the first seal 23 which is in contact with the center electrode 20 and the conductor 24. The first seal 23 is made from a mixture containing conductive powder such as metal powder, and glass powder.

Examples of the conductor 24 include a magnetic body or resistor body made of a composite material of ferrite and a conductor. The resistor body absorbs, of discharge current, components in a frequency band that can cause electric wave noise. The magnetic body blocks or absorbs, of discharge current, components in a frequency band that can cause electric wave noise, by impedance or magnetic loss due to the ferrite, or the like.

Examples of the resistor body include an element (resistor) formed by providing a coat of resistance material such as carbon-based material, metal, or metal oxide to the surface of a base material such as porcelain, an element formed by winding a resistance wire such as Ni—Cr wire around a base material such as porcelain, and a mixture containing an aggregate and conductive powder.

In the resistor body made from a mixture containing an aggregate and conductive powder, the aggregate may be, for example, glass powder or inorganic compound powder. Examples of the glass powder for the aggregate include $B_2O_3$—$SiO_2$-based powder, BaO—$B_2O_3$-based powder, $SiO_2$—$B_2O_3$—CaO-BaO-based powder, $SiO_2$—ZnO—$B_2O_3$-based powder, $SiO_2$—$B_2O_3$—$Li_2O$-based powder, and $SiO_2$—$B_2O_3$—$Li_2O$—BaO-based powder. Examples of the inorganic compound powder for the aggregate include powders of alumina, silicon nitride, mullite, steatite, and the like. Only one of these aggregates may be used, or two or more of these aggregates may be used in combination.

Examples of the conductive powder include powders made of semiconducting oxide, metal, non-metal conductive material, and the like. An example of the semiconducting oxide is $SnO_2$. Examples of the metal include Zn, Sb, Sn, Ag, Ni, Fe, and Cu. Examples of the non-metal conductive material include amorphous carbon (carbon black), graphite, silicon carbide, titanium carbide, titanium nitride, tungsten carbide, and zirconium carbide. Only one of these conductive powders may be used, or two or more of these conductive powders may be used in combination.

Examples of the magnetic body include an element formed by providing a conductor to the surface of porcelain of ferrite, an element formed by winding a metal wire around porcelain of ferrite, and an aggregated body (molded body) of magnetic particles formed by coating ferrite particles with conductive material. In the present embodiment, the conductor 24 is a mixture (resistor body) containing an aggregate and conductive powder.

A second seal 25 is a member for electrically connecting the conductor 24 and the metal terminal 30. The second seal 25 is a mixture containing conductive powder such as metal powder, and glass powder. As the conductive powders and the glass powders contained in the first seal 23 and the second seal 25, conductive powders and glass powders similar to those constituting the resistor body are used. The first seal 23 and the second seal 25 may contain semiconducting inorganic compound powder such as $TiO_2$, insulating powder, or the like as necessary.

The metal terminal 30 is a rod-shaped member to which a high-voltage cable (not shown) is connected, and is formed from a conductive metal material (e.g., low-carbon steel). The metal terminal 30 has an axial portion 31 inserted into the axial hole of the insulator 11, and a rear end portion 32 located at the rear end of the insulator 11, the axial portion 31 and the rear end portion 32 being formed contiguously. The axial portion 31 is electrically connected to the center electrode 20 via the first seal 23, the conductor 24, and the second seal 25, inside the axial hole of the insulator 11. The rear end portion 32 has a bottom surface 33 facing rearward and a projection 35 projecting rearward from an outer edge 34 (see FIG. 2B) of the bottom surface 33. The projection 35 is formed integrally with the rear end portion 32 by cold forging or the like. The metal terminal 30 is plated (e.g., nickel-plated) as necessary.

A metal shell 40 is a substantially cylindrical member made from a conductive metal material (e.g., low-carbon steel). The metal shell 40 holds the engagement portion 15 and the large-diameter portion 17 of the insulator 11 from both sides in the axial line direction, so as to retain the insulator 11. A ground electrode 41 is a rod-shaped metal member (e.g., made of nickel-based alloy) joined to the metal shell 40. The ground electrode 41 has a front end opposed to the center electrode 20 via a gap (spark gap).

Next, an example of a method for manufacturing the spark plug 10 will be described. First, a part from the front end portion 14 to the small-diameter portion 16 of the insulator 11 is inserted into a support body (not shown) made from substantially the same material as the material of the insulator 11 and formed in a tube shape, and the front-side surface of the large-diameter portion 17 of the insulator 11 is supported by an end surface of the support body. Next, the center electrode 20 is inserted into the axial hole of the insulator 11, and the head portion 22 of the center electrode 20 is engaged with the rearward facing surface 13.

In the subsequent filling step, first, raw material powder for the first seal 23 (part of connection portion) is put into the axial hole so as to be filled around the head portion 22. The raw material powder around the head portion 22 is preliminarily compressed using a compression rod (not shown). Next, raw material powder for the conductor 24 (part of connection portion) is put into the axial hole so as to be filled on the rear side of the raw material powder of the first seal 23. The filled raw material powder is preliminarily compressed using the compression rod (not shown). Next, raw material powder for the second seal 25 (part of connection portion) is put into the axial hole so as to be filled on the rear side of the conductor 24. The filled raw material powder is preliminarily compressed using the compression rod (not shown).

In a heating step, the insulator 11 supported by the support body is transferred to a heating furnace (not shown), and is heated to a temperature (800 to 1000° C.) higher than the softening point of a glass component contained in the raw material powder, for example. Thereafter, in a connection step, an upper die (not shown) of a press is pressed to the rear end portion 32 of the metal terminal 30 whose axial portion 31 is inserted into the axial hole of the insulator 11, to apply a load (e.g., about 1000 N) in the axial line direction to a lower die (not shown) supporting the insulator 11 via the support body. Thus, the axial portion 31 of the metal terminal 30 is strongly pressed to the softened raw material powder of the second seal 25, so that the softened raw material powder is compressed in the axial line direction.

When the compressed material is cooled to be cured, the first seal 23, the conductor 24, and the second seal 25 (connection portion) are formed inside the inner circumferential surface 12 of the insulator 11, and the second seal 25 is fixed to the axial portion 31 of the metal terminal 30. Thus, the metal terminal 30 and the center electrode 20 are electrically connected to each other. Next, the metal shell 40 having the ground electrode 41 connected thereto in advance is attached to the outer circumference of the insulator 11, and then the ground electrode 41 is bent such that the front end portion of the ground electrode 41 is opposed to the center electrode 20, whereby the spark plug 10 is obtained.

Figure 2A:
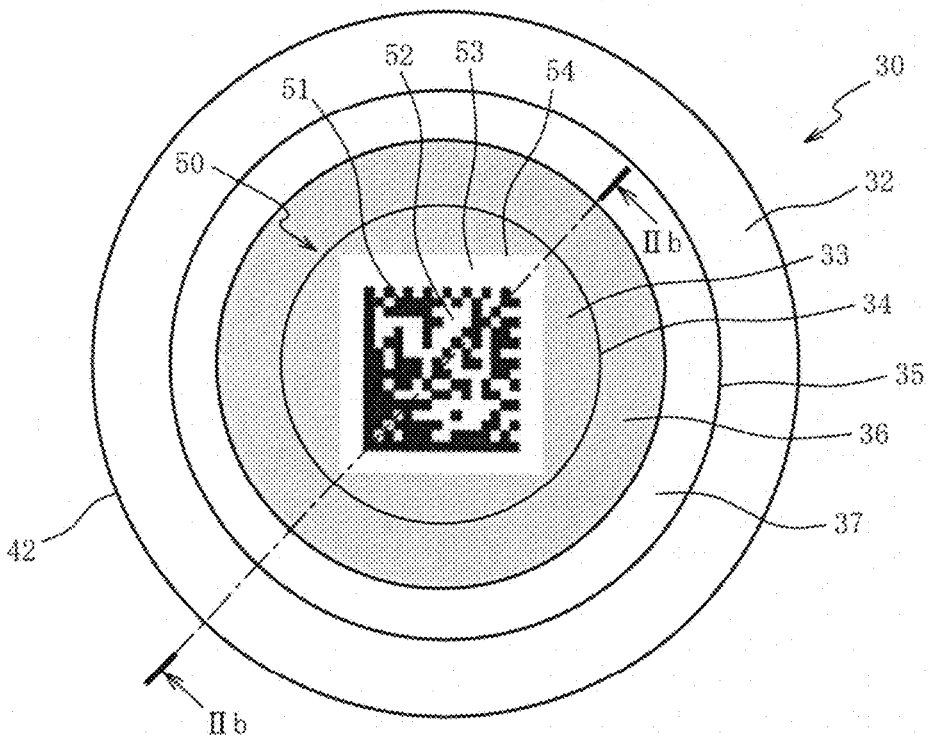
FIG. 2A is a plan view of the spark plug.
Figure 2B:
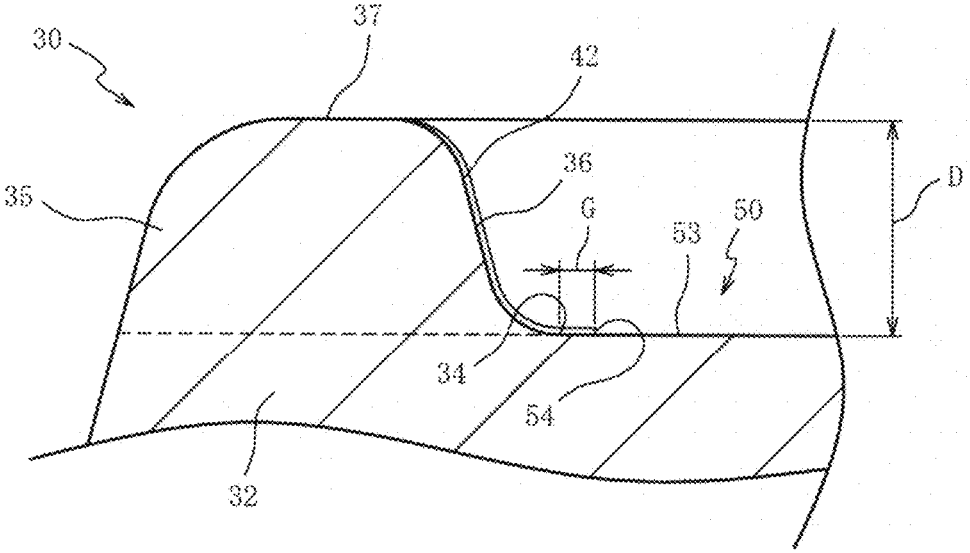
FIG. 2B is a sectional view of a metal terminal along line IIb-IIb in FIG. 2A.

With reference to FIGS. 2A and 2B, the metal terminal 30 will be described. FIG. 2A is a plan view of the spark plug 10 as seen in the axial line direction, and FIG. 2B is a sectional view of the metal terminal 30 along line IIb-IIb in FIG. 2A. In FIG. 2A, the insulator 11 and the metal shell 40 are not shown. In FIG. 2B, the front side of the rear end portion 32 of the metal terminal 30 and the center-side part of the bottom surface 33 thereof are not shown.

The metal terminal 30 has thus far received heat by processes such as heating for forming the first seal 23, the conductor 24, and the second seal 25, and therefore has an oxide film 42 formed by oxidization of the surface of the rear end portion 32 as shown in FIG. 2A. The thickness and the density of the oxide film 42 are uneven, and therefore, with the naked eye, the oxide film 42 is recognized as having shading with grey to black gray in accordance with the thickness or the density. In FIG. 2A and FIG. 2B, the oxide film 42 formed on a rear end surface 37 of the projection 35 is not shown.

A mark 50 is formed at the center of the bottom surface 33 of the rear end portion 32 on which the oxide film 42 is formed. Information indicated by the mark 50 is, for example, an identification indication of an engine (not shown) to which the spark plug 10 is mounted, and/or history information specific to the spark plug 10, the metal terminal 30, or the like, and is appropriately set as necessary. In the present embodiment, the mark 50 is a two-dimensional code. However, the mark 50 is not limited to a two-dimensional code. As the mark 50, a figure such as a circle or a triangle, a one-dimensional code (barcode), or the like, may be employed as appropriate. The bottom surface 33 on which the mark 50 is provided is a flat surface perpendicular to the axial line O. In the present embodiment, the bottom surface 33 has a round shape centered on the axial line O.

The mark 50 (code) includes a first portion 51 formed by collection of rectangular cells, and a second portion 52 formed by collection of rectangular cells having a higher reflectance than the first portion 51. In the present embodiment, the first portion 51 is set as a dark module, and the second portion 52 is set as a bright module. Various types of information are indicated by combination of the first portion 51 and the second portion 52. The mark 50 has, at an edge thereof, a margin (quiet zone) 53 for discriminating between the mark 50 and a part (oxide film 42) adjacent to the periphery of the mark 50, and the margin 53 is a part of the second portion 52 having a higher reflectance than the first portion 51.

In order to form the mark 50, first, a laser beam is applied to the bottom surface 33 to perform scanning with the laser beam along the bottom surface 33, thereby forming a rectangular base area (background) in which the oxide film 42 has been removed, at a part where the mark 50 is to be formed. The laser output, the scanning speed, the focus diameter and the focus depth of the laser beam, and the like are adjusted so as to suppress new oxidization of the bottom surface 33 as much as possible. As a result, shading variations on the background of the mark 50 are reduced while the reflectance is enhanced.

Next, a laser beam is applied to the base area so as to partially heat the base area. This promotes formation of an oxide film on the part to which the laser beam is applied. By scanning with the laser beam along the bottom surface 33, the first portion 51 is formed. The part to which the laser beam has not been applied becomes the second portion 52.

Further, a laser beam may be applied to the part corresponding to the second portion 52 so as to remove an oxide film generated on the contour part of the second portion 52 due to thermal influence when the first portion 51 is formed. In this case, the laser output, the scanning speed, the focus diameter and the focus depth of the laser beam, and the like are adjusted so as to input energy equal to the energy when the base area (background) is formed. Thus, the dimension accuracy of the first portion 51 and the second portion 52 is improved and the contrast between the first portion 51 and the second portion 52 is enhanced.

The mark 50 is formed on the metal terminal 30 at an optional timing during the manufacturing process for the spark plug 10. The timing of forming the mark 50 on the metal terminal 30 is, for example, before the heating step of heating the insulator 11 in which the raw material powder is filled, after the heating step, after the metal shell 40 is attached to the insulator 11, or after the ground electrode 41 is bent and the spark plug 10 is completed.

Reading of the mark 50 is performed by irradiating the mark 50 with illumination light and detecting, by a light receiving element (not shown), reflection light reflected by the mark 50. The light receiving element is a part of an imaging element such as CCD or CMOS having a condenser lens, a color filter, and the like. Since the first portion 51 absorbs more illumination light than the second portion 52, the light receiving element receives more reflection light from the second portion 52 than reflection light from the first portion 51.

As shown in FIG. 2B, the metal terminal 30 has the projection 35 projecting rearward (upward in FIG. 2B) from the outer edge 34 of the bottom surface 33 of the rear end portion 32. In the present embodiment, the projection 35 projects rearward from the entire circumference of the outer edge 34. An inner circumferential surface 36 of the projection 35 is smoothly contiguous to the bottom surface 33 of the rear end portion 32, and the entire inner circumferential surface 36 is positioned on the rear side with respect to the bottom surface 33. The radial-direction thickness of the projection 35 gradually decreases toward the rear end surface 37 from the bottom surface 33. In the present embodiment, the entire rear end surface 37 of the projection 35 is included in a plane perpendicular to the axial line O (see FIG. 1).

Thus, in the connection step during manufacturing of the spark plug 10, the upper die (not shown) of the press is pressed to the entire rear end surface 37 of the projection 35. The rear end surface 37 has an area of 3 $mm^2$ or greater. It is noted that the upper limit value of the area of the rear end surface 37 of the projection 35 is a value obtained by subtracting the area of the bottom surface 33 essential for forming the mark 50 from the sectional area of the rear end portion 32 along the direction perpendicular to the axial line O.

The Vickers hardness of the projection 35 at normal temperature (15 to 25° C.) is 100 HV or higher. The Vickers hardness of the projection 35 is measured in compliance with JIS Z2244:2009. The projection 35 is cut along a plane including the axial line O, and the cut surface is mirror-polished to be used as a test piece whose Vickers hardness is to be measured. In one test piece (cut surface), the projection 35 appears at two parts on both sides with respect to the axial line O. Therefore, an indenter is pushed to the center of each part of the projection 35 (parts above broken line in FIG. 2B) to form an indentation, the Vickers hardness is measured for the two parts, and the average of these values is calculated. A test force to be applied to the indenter is 980 mN, and the retention period is 15 seconds. Preferably, the Vickers hardness of the projection 35 at normal temperature is 400 HV or lower. This is for preventing deterioration of workability in manufacturing.

The rear end surface 37 of the projection 35 is positioned on the rear side with respect to the rear end in the axial line direction of the mark 50. In the present embodiment, an edge 54 (boundary between margin 53 and oxide film 42) of the mark 50 is formed by removal of the oxide film 42, and therefore, the rear end of the mark 50 refers to the surface of the oxide film 42 that is present at the edge 54 of the mark 50.

Since the Vickers hardness of the projection 35 is 100 HV or higher and the area of the rear end surface 37 of the projection 35 positioned on the rear side with respect to the rear end of the mark 50 is 3 $mm^2$ or greater, the size and the strength of the projection 35 can be ensured. Owing to the projection 35, an external force (e.g., force due to rubbing between the metal terminals 30) that can lead to peeling or damage of the mark 50 is less likely to be exerted on the bottom surface 33, and thus peeling or damage of the mark 50 can be suppressed.

In addition, since the strength of the projection 35 is ensured, in the connection step during manufacturing of the spark plug 10, deformation of the projection 35 due to a load applied to the rear end surface 37 of the projection 35 by the upper die (not shown) of the press can be suppressed. Thus, the upper die of the press can be prevented from being pressed to the bottom surface 33, whereby peeling or damage of the mark 50 can be suppressed.

It is noted that the external force that can lead to peeling or damage of the mark 50 is not limited to an external force applied to the rear end portion 32 after the mark 50 is formed on the bottom surface 33. An external force applied to the rear end portion 32 before the mark 50 is formed is also included. If an external force is applied to the bottom surface 33 before the mark 50 is formed, the bottom surface 33 might be damaged. If the mark 50 is formed on the damaged bottom surface 33, the mark 50 becomes deficient or unclear at the damaged part of the bottom surface 33, leading to occurrence of reading error of the mark 50.

Since the projection 35 projects rearward from the entire circumference of the outer edge 34 of the bottom surface 33, an external force that can lead to peeling or damage of the mark 50 is even less likely to be exerted on the bottom surface 33. Thus, the effect of suppressing peeling or damage of the mark 50 can be further enhanced.

At the rear end portion 32 of the metal terminal 30, a gap G is formed between the edge 54 of the mark 50 and the outer edge 34 of the bottom surface 33. Owing to the presence of the gap G, reduction in readability of the mark 50 due to the projection 35 can be suppressed. The size of the gap G is 0.03 mm or greater. A distance D along the axial line O (see FIG. 1) between the bottom surface 33 and the rear end surface 37 of the projection 35 is 1.5 mm or smaller. Thus, occurrence of error in reading of the mark 50 (code) by the light receiving element (not shown) can be suppressed.

It is noted that the distance D is greater than the thickness of the mark 50 formed on the bottom surface 33. This is for allowing the projection 35 to hinder an external force from being exerted on the mark 50. In the present embodiment, the distance D is greater than the thickness of the oxide film 42 present at the edge 54 of the mark 50. This is because the oxide film 42 forms the edge 54 of the mark 50.

With reference to FIG. 3, the second embodiment will be described. In the first embodiment, the case where the projection 35 is formed on the entire circumference of the outer edge 34 of the bottom surface 33 of the metal terminal 30 has been described. On the other hand, in the second embodiment, the case where projections 65, 68 are formed on parts of an outer edge 64 of a bottom surface 63 of a metal terminal 60 will be described. It is noted that the metal terminal 60 is substituted for the metal terminal 30 of the spark plug 10 described in the first embodiment. Accordingly, the same parts as those described in the first embodiment are denoted by the same reference characters and the description thereof is omitted below.

Figure 3A:
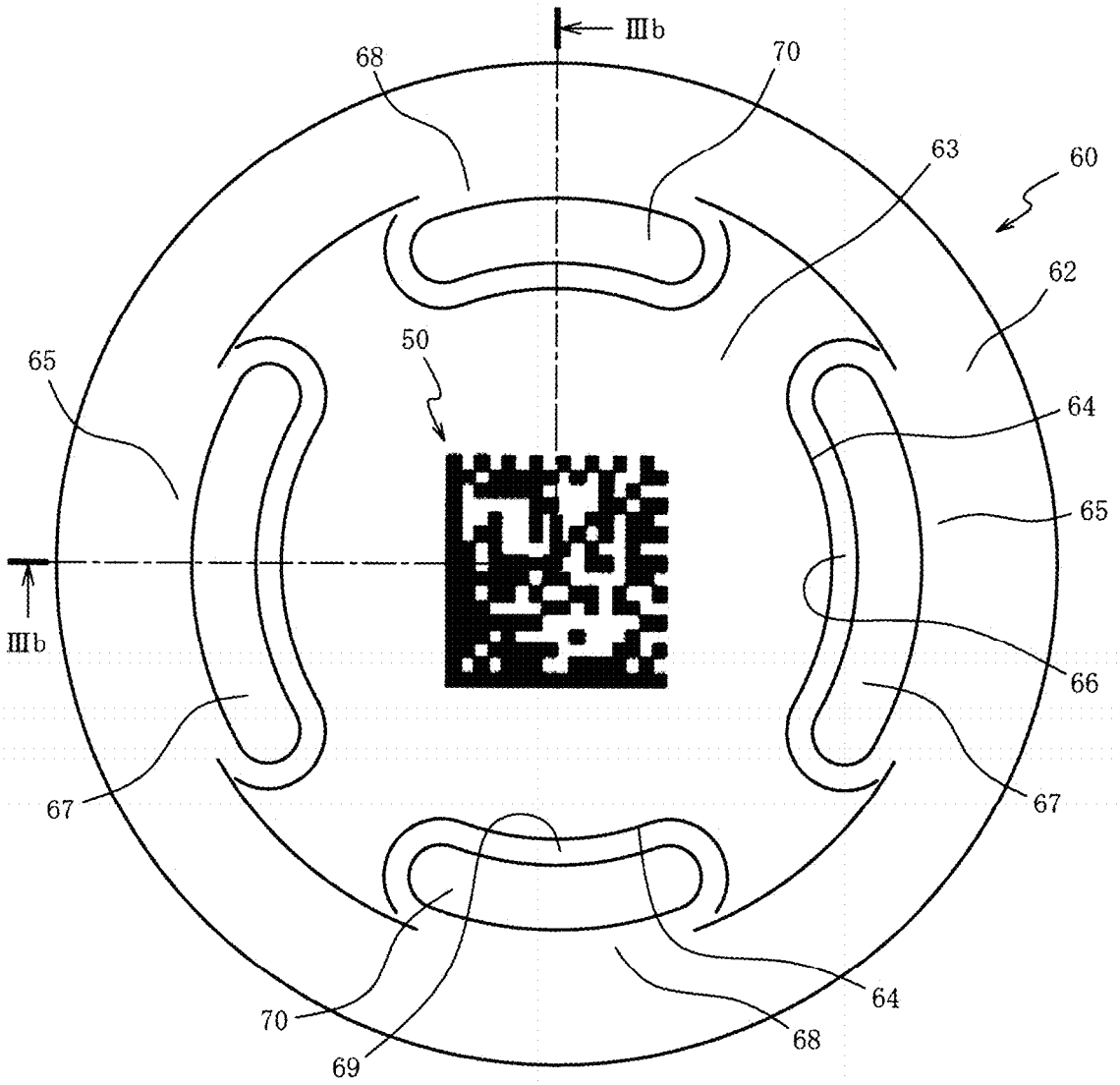
FIG. 3A is a plan view of a spark plug according to the second embodiment.
Figure 3B:
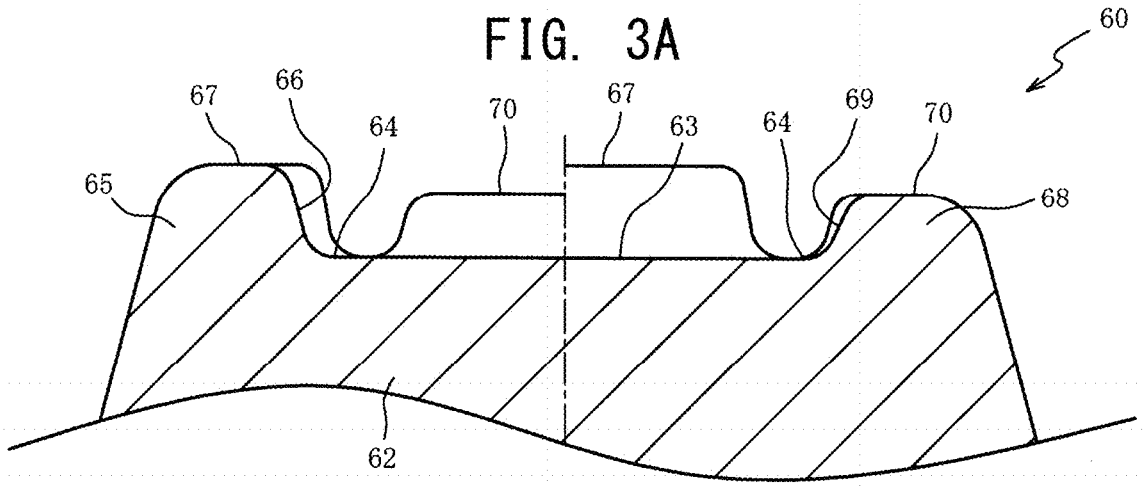
FIG. 3B is a sectional view of a metal terminal along line IIIb-IIIb in FIG. 3A.

FIG. 3A is a plan view of a spark plug according to the second embodiment, and FIG. 3B is a sectional view of the metal terminal 60 along line IIIb-IIIb in FIG. 3A. In FIG. 3A, the insulator 11 and the metal shell 40 are not shown. In FIG. 3B, the front side of the rear end portion 32 of the metal terminal 60 is not shown. The axial portion 31 (see FIG. 1) is adjacent to the front side of the rear end portion 32.

The metal terminal 60 has projections 65 projecting rearward (upward in FIG. 3B) from two locations on the outer edge 64 of the bottom surface 63 of the rear end portion 62, and has projections 68 projecting rearward from two locations on the outer edge 64 of the bottom surface 63. Each set of the projections 65, 68 are opposed to each other with the axial line O (see FIG. 1) therebetween. The mark 50 is formed at the center of the bottom surface 63, within the inner area surrounded by the projections 65, 68.

An inner circumferential surface 66 of each projection 65 is smoothly contiguous to the bottom surface 63 of the rear end portion 62, and the entire inner circumferential surface 66 is positioned on the rear side with respect to the bottom surface 63. An inner circumferential surface 69 of each projection 68 is smoothly contiguous to the bottom surface 63 of the rear end portion 62, and the entire inner circumferential surface 69 is positioned on the rear side with respect to the bottom surface 63. Rear end surfaces 67 of the projections 65 and rear end surfaces 70 of the projections 68 are positioned on the rear side with respect to the rear end of the mark 50. The radial-direction thicknesses of the projections 65, 68 gradually decrease toward the rear end surfaces 67, 70 from the bottom surface 63, respectively.

The distance along the axial line O between the rear end surface 67 of each projection 65 and the bottom surface 63 is greater than the distance along the axial line O between the rear end surface 70 of each projection 68 and the bottom surface 63. The rear end surfaces 67 of the projections 65 are included in a plane perpendicular to the axial line O (see FIG. 1). Thus, in the connection step during manufacturing of the spark plug 10, the upper die (not shown) of the press is pressed to the rear end surfaces 67 of the projections 65. The rear end surfaces 67 of the projections 65 have an area of 3 $mm^2$ or greater, and the Vickers hardness of the projections 65 at normal temperature (15 to 25° C.) is 100 HV or higher. Thus, the size and the strength of the projections 65 can be ensured. Owing to the projections 65, an external force that can lead to peeling or damage of the mark 50 is less likely to be exerted on the bottom surface 63, whereby peeling or damage of the mark 50 can be suppressed.

In addition, since the strength of the projections 65 is ensured, in the connection step during manufacturing of the spark plug 10, deformation of the projections 65 due to a load applied to the rear end surfaces 67 of the projections 65 by the upper die (not shown) of the press can be suppressed. Thus, the upper die of the press can be prevented from being pressed to the bottom surface 63, whereby peeling or damage of the mark 50 can be suppressed.

It is noted that the Vickers hardness of the projections 68 at normal temperature is also 100 HV or higher. Therefore, also owing to the projections 68, an external force that can lead to peeling or damage of the mark 50 is less likely to be exerted on the bottom surface 63. Thus, peeling or damage of the mark 50 can be suppressed.

EXAMPLES

The present invention will be described in more detail with reference to examples. However, the present invention is not limited to the examples.

(Test 1)

Various samples 1 to 6 were prepared in which the projection 35 projected rearward from the entire circumference of the outer edge 34 of the bottom surface 33 of the rear end portion 32 as in the metal terminal 30 according to the first embodiment, and the strength of the projection 35 was evaluated. Each prepared sample (metal terminal 30) was made of low-carbon steel, and the Vickers hardness of the projection 35 at normal temperature was 100 HV (test force was 980 mN, retention period was 15 seconds). The shape of the bottom surface 33 in each sample was a round shape, and the height of the projection 35 from the bottom surface 33 (distance D along axial line O between bottom surface 33 and rear end surface 37 of projection 35) was 1.0 mm. In these samples, the outer diameters of the projections 35 were the same but the inner diameters thereof were made different, so that the rear end surfaces 37 of the projections 35 had different areas.

The test was performed in which, with each sample heated in a heating furnace at 900° C. (furnace inside temperature), the upper die of the press was pressed to the rear end surface 37 of the projection 35 to apply a load of 1000 N in the axial line direction to the projection 35 between the upper die and the lower die. The sample was taken out from the heating furnace, and after the sample was cooled to normal temperature, the height (distance D) of the projection 35 from the bottom surface 33 of the sample was measured. The sample in which the height of the projection 35 was decreased by 0.1 mm or more after the test was evaluated as suffering deformation of the projection 35 (Bad), and the sample in which change in the height of the projection 35 between before and after the test was less than 0.1 mm was evaluated as having a sufficient strength (Good). The results are shown in Table 1.

TABLE 1

| No. | Area ($mm^2$) | Evaluation |
|---|---|---|
| 1 | 2.00 | Bad |
| 2 | 2.25 | Bad |
| 3 | 2.50 | Bad |
| 4 | 2.75 | Bad |
| 5 | 3.00 | Good |
| 6 | 3.25 | Good |

As shown in Table 1, in samples 1 to 4 in which the area of the rear end surface 37 of the projection 35 was smaller than 3 $mm^2$, the projection 35 was deformed. On the other hand, in the samples 5, 6 in which the area of the rear end surface 37 of the projection 35 was 3 $mm^2$ or greater, the projection 35 was hardly deformed. Thus, it has been found that, in the case where the Vickers hardness of the projection 35 is 100 HV, if the area of the rear end surface 37 of the projection 35 is 3 $mm^2$ or greater, the projection 35 is hardly deformed even when a load of 1000 N is applied to the projection 35 under the condition of 900° C. (furnace inside temperature).

(Test 2)

Various samples 7 to 11 were prepared in which the projection 35 projected rearward from the entire circumference of the outer edge 34 of the bottom surface 33 of the rear end portion 32 as in the metal terminal 30 according to the first embodiment, and the strength of the projection 35 was evaluated. Each prepared sample (metal terminal 30) was made of low-carbon steel, and the rear end surface 37 of the projection 35 in each sample had an area of 3 $mm^2$. In each sample, the shape of the bottom surface 33 was a round shape, and the height of the projection 35 from the bottom surface 33 (distance D along axial line O between bottom surface 33 and rear end surface 37 of projection 35) was 1.0 mm. The samples were subjected to quenching or annealing so that the projections 35 were different in the Vickers hardness (test force was 980 mN, retention period was 15 seconds) at normal temperature.

The test was performed in which, with each sample heated in a heating furnace at 900° C. (furnace inside temperature), the upper die of the press was pressed to the rear end surface 37 of the projection 35 to apply a load of 1000 N in the axial line direction to the projection 35 between the upper die and the lower die. The sample was taken out from the heating furnace, and after the sample was cooled to normal temperature, the height (distance D) of the projection 35 from the bottom surface 33 of the sample was measured. The sample in which the height of the projection 35 was decreased by 0.1 mm or more after the test was evaluated as suffering deformation of the projection 35 (Bad), and the sample in which change in the height of the projection 35 between before and after the test was less than 0.1 mm was evaluated as having a sufficient strength (Good). The results are shown in Table 2.

TABLE 2

| No. | Hardness (HV) | Evaluation |
|---|---|---|
| 7 | 50 | Bad |
| 8 | 80 | Bad |
| 9 | 100 | Good |
| 10 | 120 | Good |
| 11 | 150 | Good |

As shown in Table 2, in samples 7, 8 in which the Vickers hardness of the projection 35 was lower than 100 HV, the projection 35 was deformed. On the other hand, in the samples 9 to 11 in which the Vickers hardness of the projection 35 was 100 HV or higher, the projection 35 was hardly deformed. Thus, it has been found that, in the case where the area of the rear end surface 37 of the projection 35 is 3 $mm^2$, if the Vickers hardness of the projection 35 is 100 HV or higher, the projection 35 is hardly deformed even when a load of 1000 N is applied to the projection 35 under the condition of 900° C. (furnace inside temperature).

According to tests 1, 2, it is inferred that, in the case where the Vickers hardness of the projection 35 is 100 HV or higher and the area of the rear end surface 37 of the projection 35 is 3 $mm^2$ or greater, the projection 35 is hardly deformed even when a force in the axial line direction is applied to the projection 35 in the connection step during manufacturing of the spark plug 10. In the case where the mark 50 is formed on the bottom surface 33 of the metal terminal 30 before the connection step, it is possible to suppress peeling of the mark 50 even when having undergone the connection step. In the case where the mark 50 is formed on the bottom surface 33 of the metal terminal 30 after the connection step, it is possible to suppress damage of the bottom surface 33 even when having undergone the connection step. Since damage of the bottom surface 33 can be suppressed, occurrence of defect such as losing of the mark 50 can be suppressed when the mark 50 is formed on the bottom surface 33.

(Test 3)

Samples were prepared in which the projection 35 projected rearward from the entire circumference of the outer edge 34 of the bottom surface 33 of the rear end portion 32 as in the metal terminal 30 according to the first embodiment, and the mark 50 was formed on the bottom surface 33 in each sample. The shape of the bottom surface 33 of each sample (metal terminal 30) was a round shape, and the area of the rear end surface 37 of the projection 35 was 3 $mm^2$. Each mark 50 was a two-dimensional code having the same size, which was formed by applying a laser beam. In accordance with ISO/IEC TR29158:2011, reading performance was evaluated. The samples were different in the height of the projection 35 from the bottom surface 33 (distance D along axial line O between bottom surface 33 and rear end surface 37 of projection 35) and in the gap G (minimum value) between the edge 54 of the mark 50 and the outer edge 34 of the bottom surface 33. The reading result (grade) is shown in Table 3. In Table 3, "U" indicates that reading could not be performed.

TABLE 3

| | | Gap G (mm) | | | | |
|---|---|---|---|---|---|---|
| | | 0.020 | 0.025 | 0.030 | 0.080 | 0.100 |
| Distance D (mm) | 0.50 | D | D | B | A | A |
| | 0.70 | F | F | B | A | A |
| | 1.00 | U | F | B | A | A |
| | 1.50 | U | U | B | B | A |
| | 2.00 | U | U | U | F | F |

A large mark 50 is preferred because the information amount can be increased, but enlarging the mark 50 leads to reduction in the gap G. As shown in Table 3, it has been found that, in the case where the gap G is smaller than 0.03 mm, the grade is low and reading error is more likely to occur. On the other hand, in the case where the gap G is 0.03 mm or higher and the distance D is 1.50 mm or smaller, the grade is A or B. Therefore, it has been found that, if the gap G and the distance D are set to satisfy this condition, occurrence of reading error of the mark 50 can be suppressed while peeling or damage of the mark 50 is suppressed by the projection 35.

Although the present invention has been described with reference to the embodiments, the present invention is not limited to the above embodiments at all. It can be easily understood that various modifications can be devised without departing from the gist of the present invention.

In the above embodiments, the spark plug 10 in which the conductor 24 and the second seal 25 are interposed between the first seal 23 and the metal terminal 30, 60 has been described, but the present invention is not necessarily limited thereto. As a matter of course, it is also possible that the head portion 22 of the center electrode 20 and the axial portion 31 of the metal terminal 30, 60 are connected via the first seal 23 without providing the conductor 24 and the second seal 25.

In this case, in the manufacturing process for the spark plug, after the raw material powder for the first seal 23 is filled in the axial hole of the insulator 11, the insulator 11 is heated and the axial portion 31 of the metal terminal 30, 60 is inserted into the axial hole. In the connection step, the axial portion 31 is pressed to the softened raw material powder of the first seal 23, and the metal terminal 30, 60 is fixed to the insulator 11 via the cured first seal 23.

Also in this step, an external force due to rubbing between the metal terminals 30, 60 or the like, or an external force occurring when the axial portion 31 is pressed to the raw material powder of the first seal 23, is likely to be exerted on the rear end portion 32, 62 of the metal terminal 30, 60. Considering this, the Vickers hardness of the projection 35, 65, 68 is set to 100 HV or higher, and the area of the rear end surface 37, 67 of the projection 35, 65 is set to 3 $mm^2$ or greater, whereby the size and the strength of the projection 35, 65, 68 are ensured and thus such an external force that can lead to peeling or damage of the mark 50 can be less likely to be exerted on the bottom surface 33, 63.

In the above embodiment, the case where the entire rear end surface 37 of the projection 35 formed on the rear end portion 32 of the metal terminal 30 is included in a plane perpendicular to the axial line O (the case where the height of the projection 35 is uniform in the circumferential direction of the rear end portion 32), has been described. However, the present invention is not necessarily limited thereto. As a matter of course, the height of the projection 35 may vary in the circumferential direction of the rear end portion 32. In this case, the area of the rear end surface of the projection 35 refers to an area of the highest part of the projection 35. This is because, the higher the projection 35 is, the less likely an external force that can lead to peeling or damage of the mark 50 is exerted on the bottom surface 33.

In the above embodiment, the case where, in forming the mark 50, the first portion 51 (dark module) is formed after the base area (background) is formed, has been described. However, the present invention is not necessarily limited thereto. In the case where the oxide film 42 has high brightness (high reflectance), as a matter of course, it is also possible that, in forming the mark 50, a laser beam is applied to the oxide film 42 to form the first portion 51 on the oxide film 42 without providing the base area.

On the other hand, in the case where the oxide film 42 has low brightness (low reflectance), as a matter of course, it is also possible that, in forming the mark 50, a laser beam is applied to the oxide film 42 and the oxide film 42 is partially removed to form the second portion 52, without providing the base area.

Although not described in the above embodiments, as a matter of course, the mark 50 in which the bright module and the dark module are reversed to each other may be provided to the metal terminal 30, 60. In this case, the margin 53 of the mark 50 is a part of the first portion 51 (dark module).

In the above embodiments, the case of forming the mark 50 by applying a laser beam to the metal terminal 30, 60 has been described. However, the present invention is not necessarily limited thereto. As a matter of course, the mark 50 may be printed on the metal terminal 30, 60, using ink. As the ink, an ultraviolet curing type, an electron beam curing type, a thermosetting type, or the like may be employed as appropriate. In this case, the rear end of the mark 50 refers to the rear end of the cured ink.

In the embodiments, the following invention is also disclosed. Disclosed is a method for manufacturing a spark plug including: an insulator having an axial hole formed along an axial line extending from a front side to a rear side; a center electrode provided on a front side of the axial hole of the insulator; a metal terminal provided on a rear side of the axial hole of the insulator; and a connection portion electrically connecting the metal terminal and the center electrode, the metal terminal having, at a rear end portion thereof, a bottom surface facing rearward and a projection projecting rearward from an outer edge of the bottom surface, a mark being provided to at least a part of the bottom surface, the method including: a center electrode placing step of placing the center electrode in the axial hole; a filling step of filling raw material powder for the connection portion on a rear side of the center electrode; and a connection step of pressing the metal terminal inserted in the axial hole, to the raw material powder for the connection portion, in a hot condition, wherein the Vickers hardness of the projection is 100 HV or higher, the rear end surface of the projection is positioned on a rear side with respect to a rear end of the mark, and an area of the rear end surface is 3 $mm^2$ or greater.

In this spark plug manufacturing method, the strength of the projection can be ensured, and therefore damage or deformation of the projection can be suppressed in the connection step. Thus, an external force can be less likely to be exerted on the bottom surface of the metal terminal, and therefore peeling or damage of the mark can be suppressed.

DESCRIPTION OF REFERENCE NUMERALS

10: spark plug
11: insulator
30, 60: metal terminal
32, 62: rear end portion
33, 63: bottom surface
34, 64: outer edge
35, 65, 68: projection
37, 67: rear end surface
50: mark
54: edge
D: distance
G: gap Having described the invention, the following is claimed:

1. A spark plug comprising:
an insulator having an axial hole formed along an axial line extending from a front side to a rear side; and
a metal terminal provided on a rear side of the axial hole of the insulator, wherein
the metal terminal has, at a rear end portion thereof, a bottom surface facing rearward and a projection projecting rearward from an outer edge of the bottom surface, a mark being provided to at least a part of the bottom surface,
Vickers hardness of the projection is 100 HV or higher,
a rear end surface of the projection is positioned on a rear side with respect to a rear end of the mark, and
an area of the rear end surface is 3 $mm^2$ or greater.

2. The spark plug according to claim 1, wherein
the projection projects rearward from an entire circumference of the outer edge of the bottom surface.

3. The spark plug according to claim 1, wherein
a gap is provided between an edge of the mark provided to the bottom surface and the outer edge of the bottom surface.

4. The spark plug according to claim 2, wherein
a gap is provided between an edge of the mark provided to the bottom surface and the outer edge of the bottom surface.

5. The spark plug according to claim 1, wherein
the mark is a code that allows information to be read therefrom with use of reflected light,
a gap between an edge of the code provided to the bottom surface and the outer edge of the bottom surface is 0.03 mm or greater, and
a distance along the axial line between the bottom surface and the rear end surface of the projection is 1.5 mm or smaller.

6. The spark plug according to claim 2, wherein
the mark is a code that allows information to be read therefrom with use of reflected light,
a gap between an edge of the code provided to the bottom surface and the outer edge of the bottom surface is 0.03 mm or greater, and
a distance along the axial line between the bottom surface and the rear end surface of the projection is 1.5 mm or smaller.

7. The spark plug according to claim 3, wherein
the mark is a code that allows information to be read therefrom with use of reflected light,
a gap between an edge of the code provided to the bottom surface and the outer edge of the bottom surface is 0.03 mm or greater, and
a distance along the axial line between the bottom surface and the rear end surface of the projection is 1.5 mm or smaller.

* * * * *